US007059912B2

(12) United States Patent
Tsai

(10) Patent No.: US 7,059,912 B2
(45) Date of Patent: Jun. 13, 2006

(54) ELECTRICAL CONNECTOR HAVING VERTICALLY MOVABLE BASES TO ENHANCE OVERALL LEVELNESS OF PINS

(76) Inventor: Chou Hsuan Tsai, 15f,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/226,528

(22) Filed: Sep. 13, 2005

(65) Prior Publication Data

US 2006/0057894 A1 Mar. 16, 2006

(51) Int. Cl.
*H01R 24/00* (2006.01)

(52) U.S. Cl. ..... 439/630; 439/247

(58) Field of Classification Search ..... 439/165, 439/164, 247, 634, 630; 29/876, 884
See application file for complete search history.

(56) References Cited

U.S. PATENT DOCUMENTS 6,612,492 B1 * 9/2003 Yen ..... 235/451
6,738,259 B1 * 5/2004 Le et al. ..... 361/737
6,776,653 B1 * 8/2004 Hsiao ..... 439/541.5

* cited by examiner

*Primary Examiner*—Tho D. Ta
*Assistant Examiner*—Vanessa Girardi
(74) *Attorney, Agent, or Firm*—Pro-Techtor Int'l Services

(57) ABSTRACT

An electrical connector includes two floating bases, an outer casing and a positioning structure. The floating bases may be moved vertically. One row of terminals is disposed on each floating base. Each terminal has an elastic contact and a pin to be bonded to a circuit board. The outer casing engages with the floating bases and covers a top and two sides of each floating base. The positioning structure is disposed on the outer casing and each floating base to make each floating base movable only in a vertical direction.

19 Claims, 7 Drawing Sheets

ELECTRICAL CONNECTOR HAVING VERTICALLY MOVABLE BASES TO ENHANCE OVERALL LEVELNESS OF PINS

BACKGROUND OF THE INVENTION

1. Field of the Invention

The invention relates to an electrical connector, and more particularly to an electrical connector having vertically movable bases to enhance overall levelness of pins and enhance the bonding of the pins to a circuit board.

2. Description of the Related Art

The electrical cards used in a computer include multimedia storage cards and memory cards, wherein the memory cards in the current market have various specifications, such as those of a Secure Digital Card (SDC), a Muti-Media Card (MMC), a Smart Media Card (SMC), a Memory Stick Card (MSC), a XD-Picture Card (XDC), and the like. Because the positions of connection points of the memory cards with different specifications are different, the electrical connectors for the memory cards with different specifications are different.

In order to facilitate the usage, the manufacturers try to integrate various kinds of electrical connectors into an integrated electrical connector suitable for various memory cards with different specifications. Because several memory cards with different specifications have to be integrated, the integrated electrical connector has to be provided with several kinds of terminals for the memory cards with different specifications. Thus, the number of the terminals is quite great, and the overall levelness of the pins of the terminals cannot be ensured to be 100%. Hence, the bonding of the terminals has to be configured such that they can be repaired and bonded. As shown in FIG. 1, for the sake of the repair bonding, the pins 11 of the terminals horizontally protrude over two sides of the plastic base 12. Thus, when the electrical connector is bonded to a mainboard, the repair bonding process may be performed if some pins of the terminals are found to be in poor bonded conditions.

The conventional memory card connector usually has pins of terminals protruding over the lateral sides of the base, and it is difficult to arrange a great number of terminals because the positions at two sides for the protruding pins as well as the space are limited. Furthermore, it is difficult to manufacture the connector as the interval between adjacent pins becomes smaller.

In order to meet the requirement of the repair bonding, the pins of the terminals only can be arranged at two sides of the base, which is difficult to be achieved and the limited space also cannot accommodate more terminals. In addition, if the pins of the terminals are arranged at the wide bottom surface of the base conveniently, the repair bonding process still cannot be performed. So, the prior art cannot effectively integrate various memory card connectors into an integrated connector suitable for various memory cards in a good production way.

SUMMARY OF THE INVENTION

It is therefore an object of the invention to provide an electrical connector having vertically movable bases to enhance overall levelness of pins and enhance the bonding of the pins to a circuit board.

It is therefore another object of the invention to provide an electrical connector having vertically movable bases, which may be moved vertically relative to an outer casing, to enhance overall levelness of pins and mounting sheets of the outer casing and enhance the bonding of the pins to a circuit board.

To achieve the above-identified objects, the invention provides an electrical connector including at least two floating bases, an outer casing and a positioning structure. The at least two floating bases may be moved vertically. At least one row of terminals is disposed on each of the at least two floating bases. Each of the terminals has an elastic contact and a pin to be bonded to a horizontal circuit board. The outer casing engages with the at least two floating bases and covers a top and two sides of each of the at least two floating bases. The positioning structure is disposed on the outer casing and each of the at least two floating bases to make each of the at least two floating bases movable only in a vertical direction.

According to the above-mentioned structure, the pins of the terminals on the floating bases may be adjusted to locate at the same level because the floating bases may be moved vertically relative to the outer casing. So, the bonding effects of the pins to the circuit board may be enhanced.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
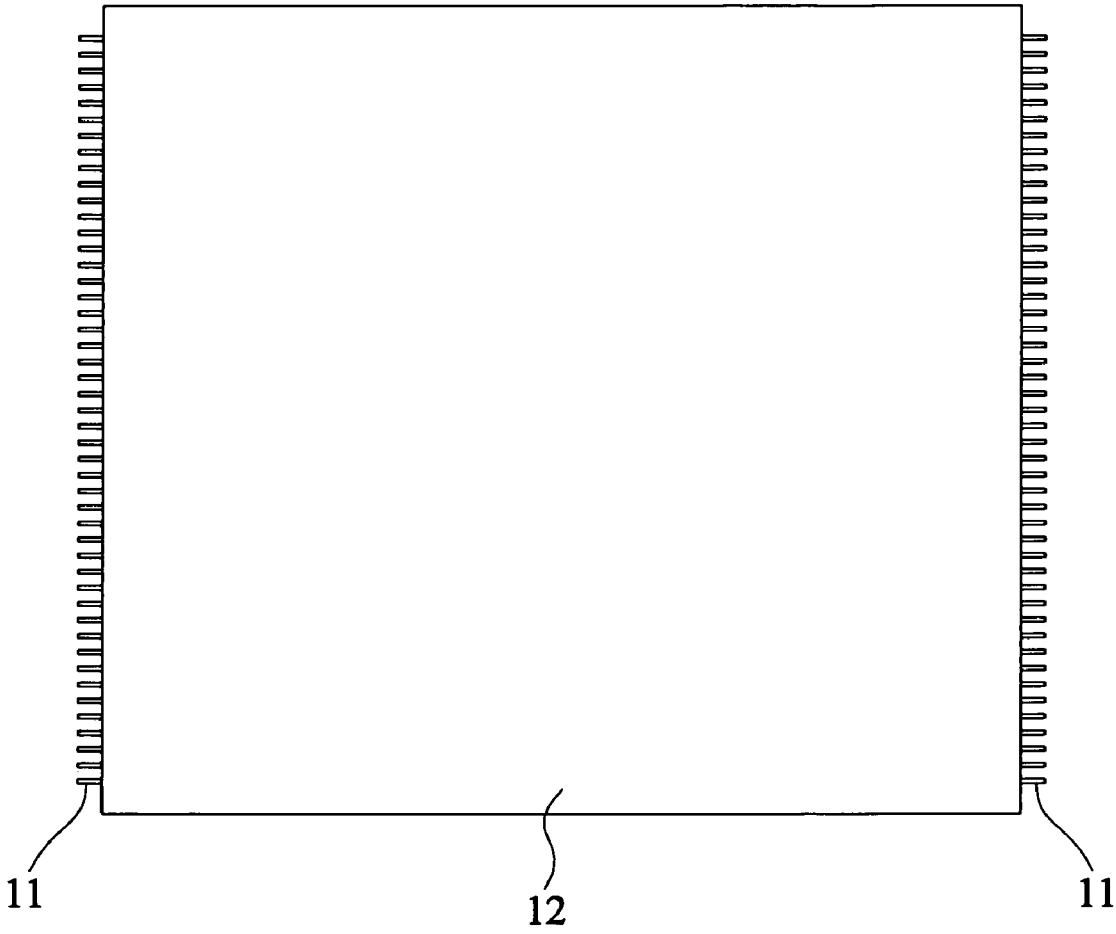
FIG. 1 (Prior Art)
FIG. 1 is a schematic top view showing a conventional electrical card connector.
Figure 2:
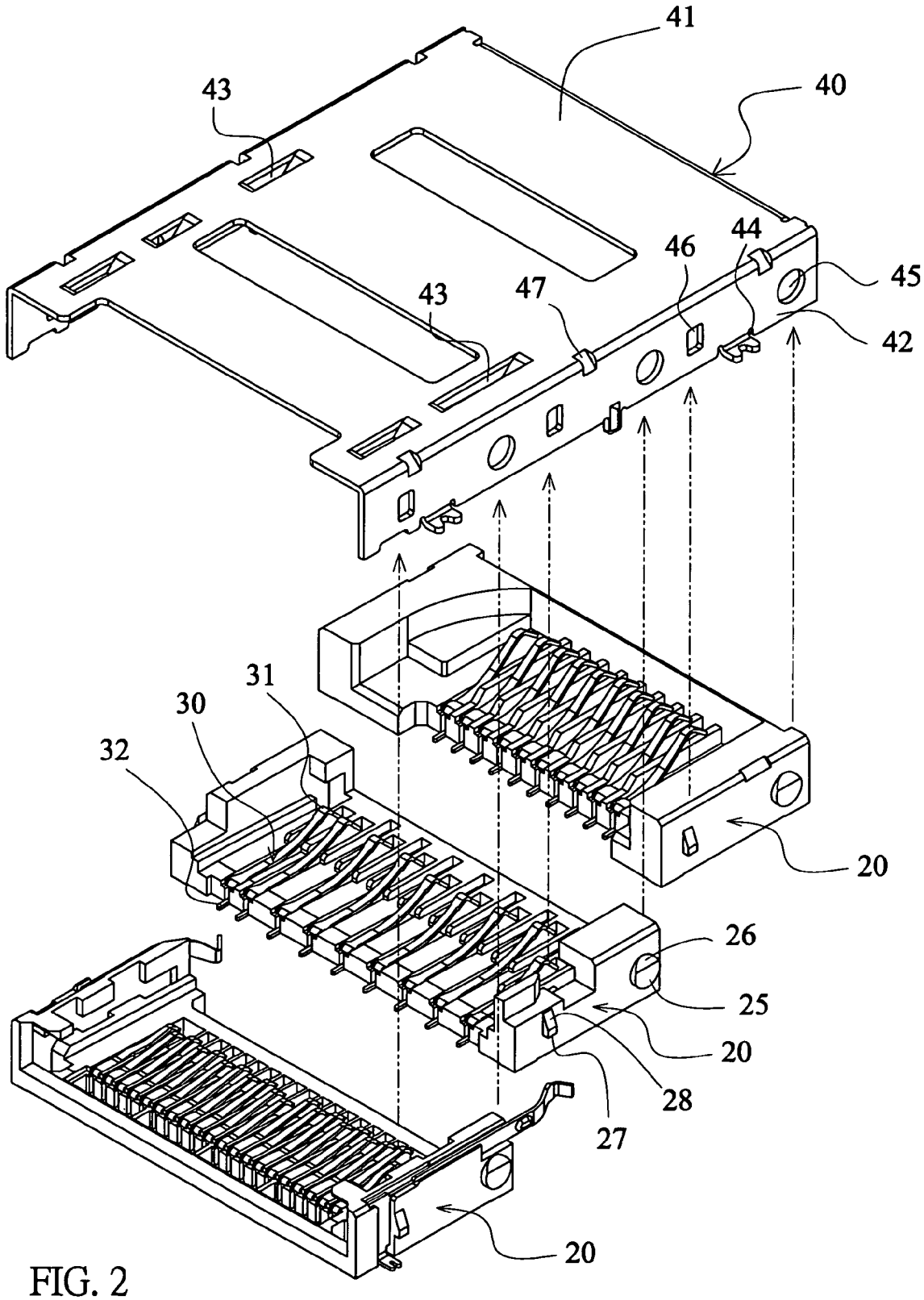
FIG. 2 is a pictorially exploded view showing an electrical connector according to a first embodiment of the invention.
Figure 3:
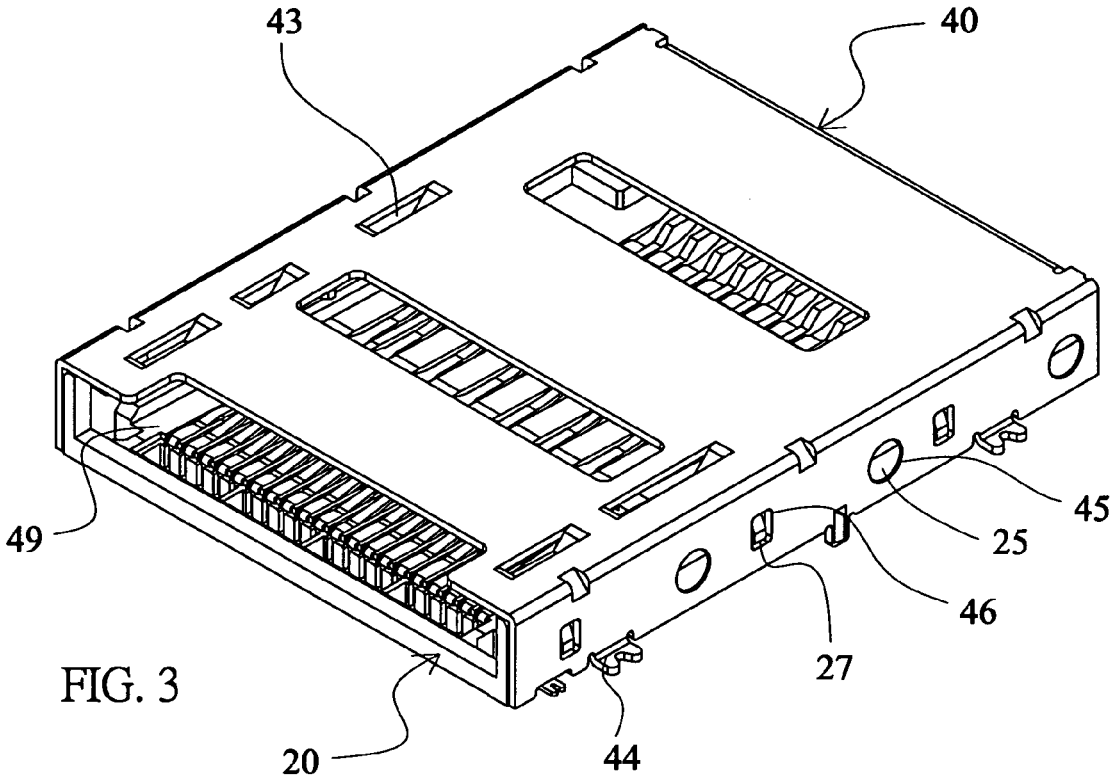
FIG. 3 is a pictorially assembled view showing the electrical connector according to the first embodiment of the invention.
Figure 4:
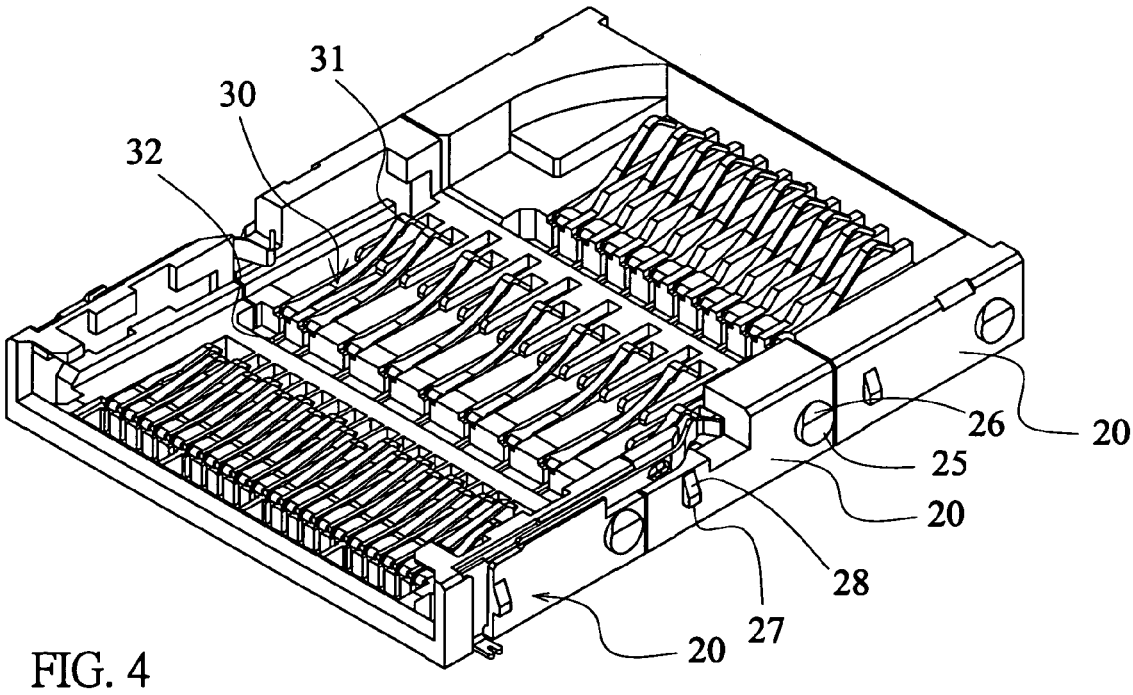
FIG. 4 is a pictorially assembled view showing a plastic base according to the first embodiment of the invention.
Figure 5:
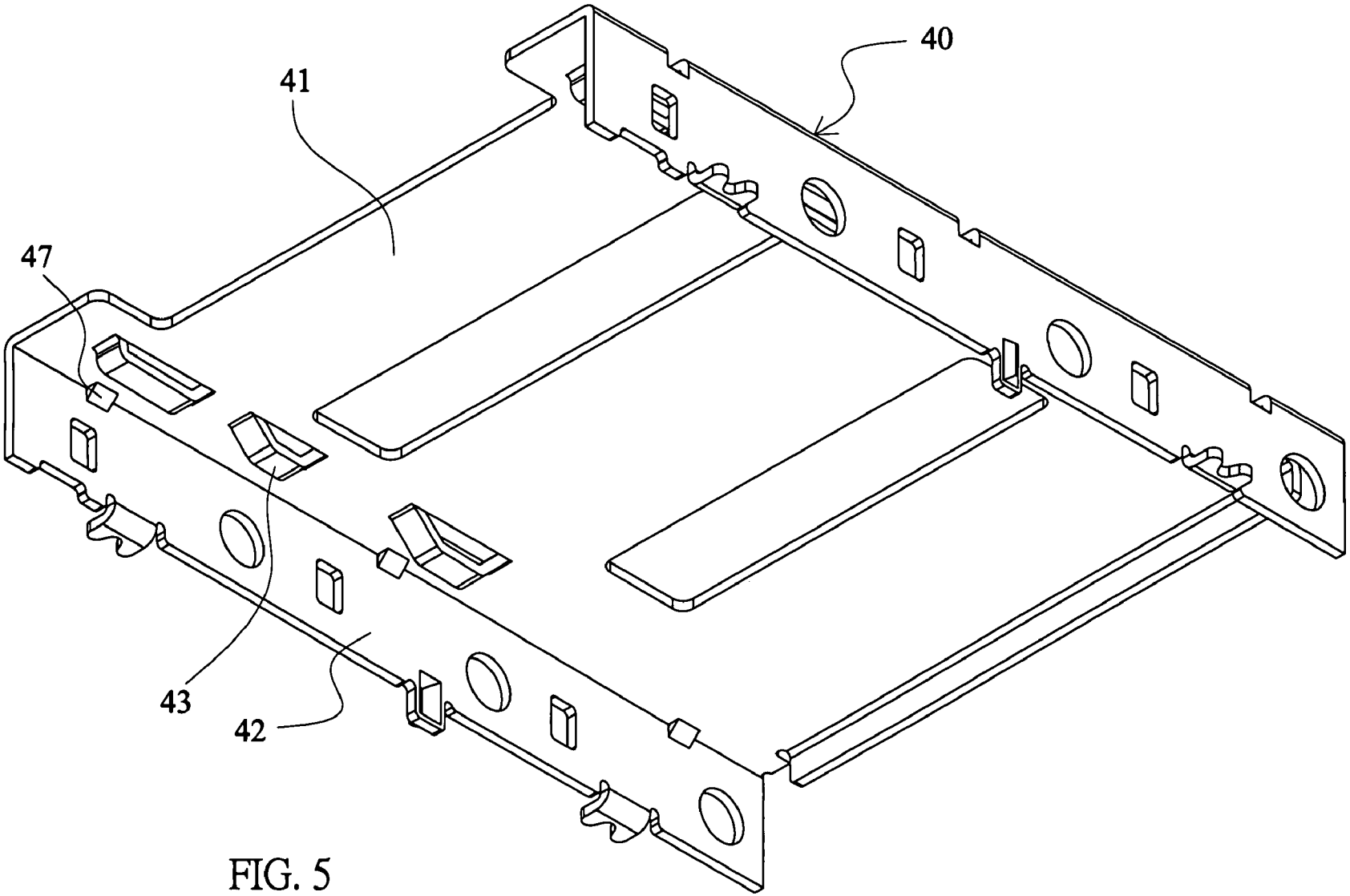
FIG. 5 is a pictorial view showing an outer casing according to the first embodiment of the invention.

Referring to FIGS. 2 to 5, an electrical card connector capable of receiving multiple cards in this embodiment includes three floating bases 20, a plurality of terminals 30, an outer casing 40 and a positioning structure.

The three floating bases 20 in different shapes constitute a plastic base of the electrical connector. One row of terminals 30 is disposed on each of the floating bases 20. Each terminal 30 has an elastic contact 31 and a pin 32 to be bonded to a horizontal circuit board. The pin 32 extends horizontally to a first end of the floating base 20.

The outer casing 40 made of an iron material has a top surface 41, two side surfaces 42, and ribs 43 formed by pressing the top surface 41 downwardly at proper positions at two sides. The outer casing 40 engages with the three floating bases 20 and covers a top and two sides of each of the floating bases 20. The ribs 43 of the outer casing 40 and the three floating bases 20 in different shapes are combined together to form a plurality of card slots 49 with different widths or heights. The card slots 49 comminute with each other and share a space, such that electrical cards with different dimensions or specifications may be inserted into the card slots. In addition, mounting sheets 44 are formed at front and rear ends close to the two side surfaces 42 of the outer casing 40. The connections between the top surface 41 and the two side surfaces 42 are formed with a plurality of reinforcement ribs 47 by way of pressing, such that the structure intensity of the inverse-U shaped outer casing 40 may be enhanced.

The positioning structure is disposed on the outer casing 40 and each floating base 20 to make each floating base 20 movable only in a vertical direction when the outer casing 40 engages with each floating base 20. The positioning structure includes pivots 25 disposed at two sides of a second end of the floating base 20 opposite to the first end of the floating base 20, engaging blocks 27 disposed at two sides of the first end of the floating base 20 at which the pins 32 of the terminals extend, pivotal holes 45 formed at the two side surfaces 42 of the outer casing 40 corresponding to the two pivots 25, and two engagement openings 46 formed at the two side surfaces 42 corresponding to the two engaging blocks 27. The vertical dimension of the engagement opening 46 is longer than that of the engaging block 27 such that the first end of the floating base 20 may be moved vertically relative to the outer casing 40. In addition, a top of the pivot 25 is formed with a guide bevel 26, and a top of the engaging block 27 is also formed with a guide bevel 28. The floating base 20 and the outer casing 40 may be easily assembled through the guide bevels 26 and 28.

Figure 6:
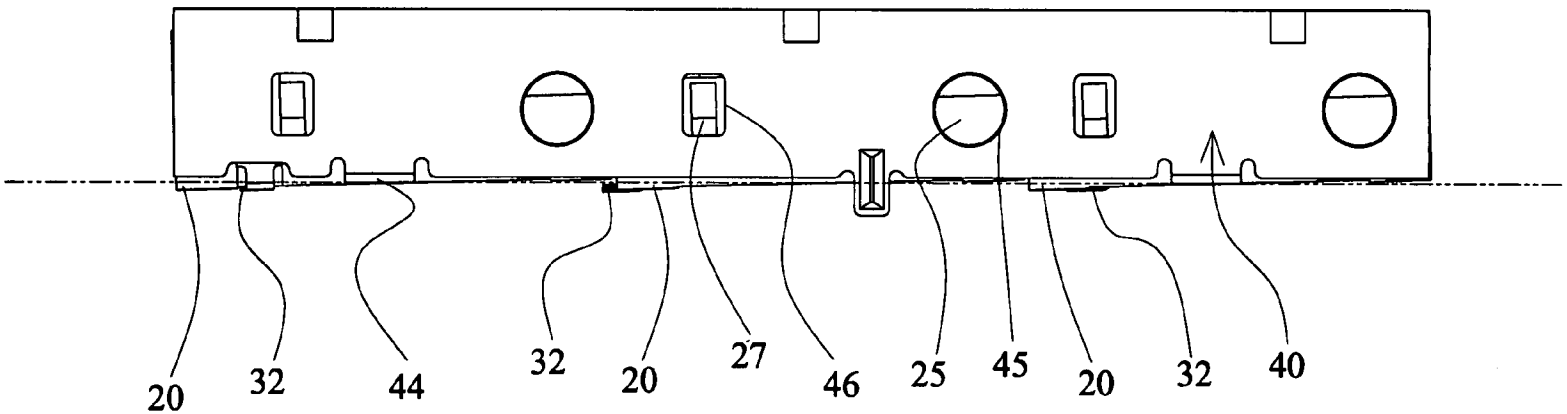
FIG. 6 is a side view showing the connector in a suspended state according to the first embodiment of the invention.
Figure 7:
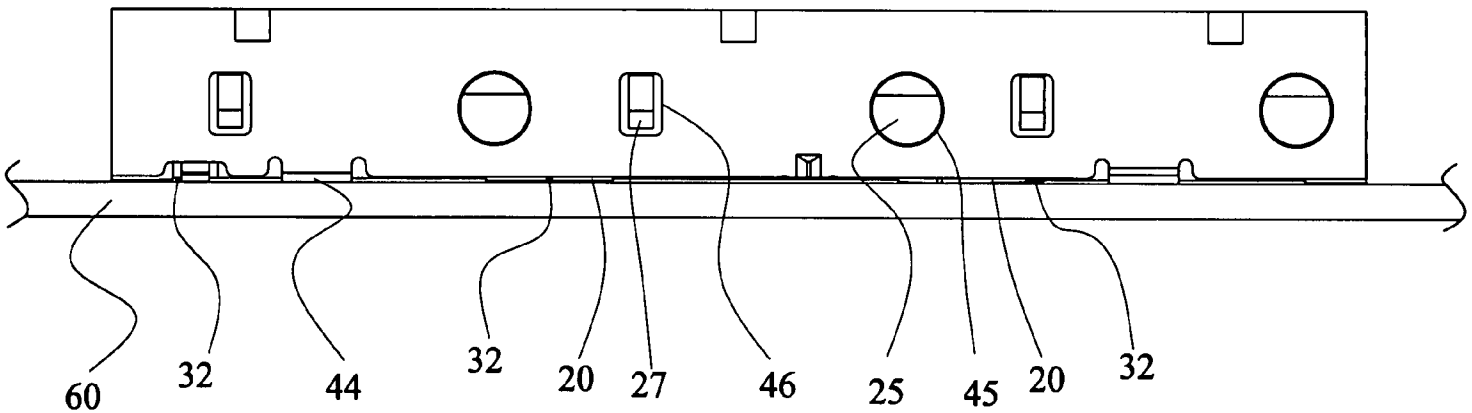
FIG. 7 is a side view showing a used state of the connector according to the first embodiment of the invention.

FIG. 6 shows a suspended state of the electrical connector, wherein the phantom line is a horizontal line. The second end of the floating base 20 is pivotally connected to the pivotal hole 45 of the outer casing 40 through the pivot 25, and the first end of the floating base 20 engages with the engagement opening 46 of the outer casing 40 through the engaging block 27. Because the vertical dimension of the engagement opening 46 is greater than that of the engaging block 27, the floating base 20 may be rotated about the pivot 25 disposed at the second end of the floating base 20 such that the first end of the floating base 20 may be moved vertically relative to the outer casing 40, and the levels of the pins 32 of the terminals may be adjusted relative to the outer casing 40. As shown in FIG. 7, because the floating bases 20 may be moved vertically relative to the outer casing 40, the pins 32 of the terminals on the floating bases 20 may be adjusted into the same level after the floating bases 20 are disposed on a horizontal circuit board 60, such that the pins 32 may be in contact with the circuit board 60 and thus be bonded to the circuit board 60. Meanwhile, the mounting sheets 44 of the outer casing 40 may also be adjusted to locate at the same level as that of the pins 32 such that the pins may be bonded to the circuit board 60.

Thus, the invention has the following advantages.

1. The terminals 30 may be separately arranged on the floating bases 20, and the levels of the pins 32 of the terminals 30 on the floating bases 20 may be adjusted to be the same level because the floating bases 20 may be vertically moved relative to the outer casing 40, so that the bonding effects of the pins to the circuit board may be enhanced.

2. The mounting sheets 44 of the outer casing 40 may be ensured to be located at the same level as that of the pins 32 of the terminals 30, and the bonding effect of all the pins to the circuit board may be enhanced.

3. The pins 32 and the mounting sheets 44 may be adjusted to locate at the same level because the floating bases 20 may be vertically moved relative to the outer casing 40. So, the tolerance of the connector may be larger, and the connector may be easily manufactured.

Figure 8:
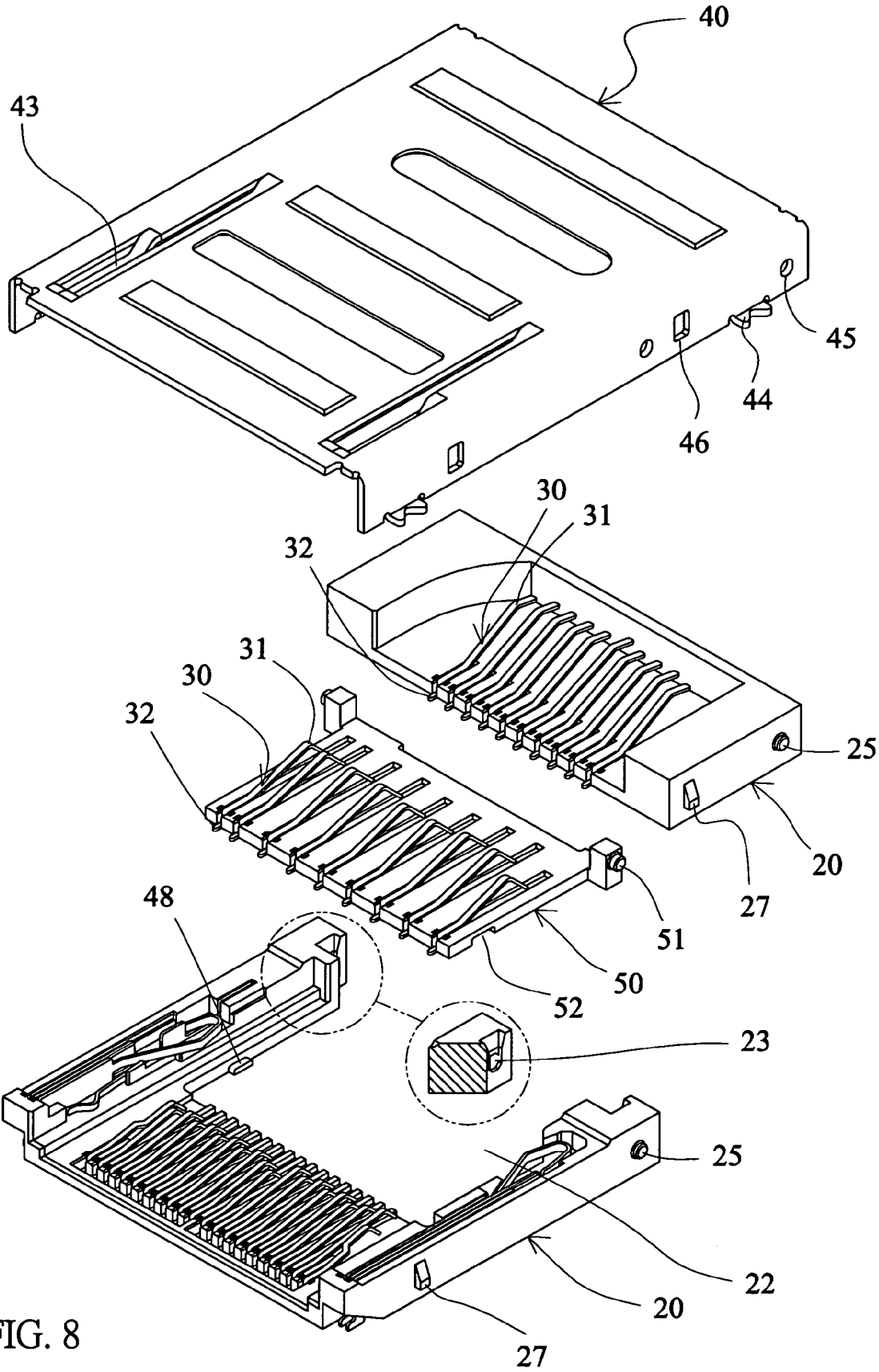
FIG. 8 is a pictorially exploded view showing an electrical connector according to a second embodiment of the invention.
Figure 9:
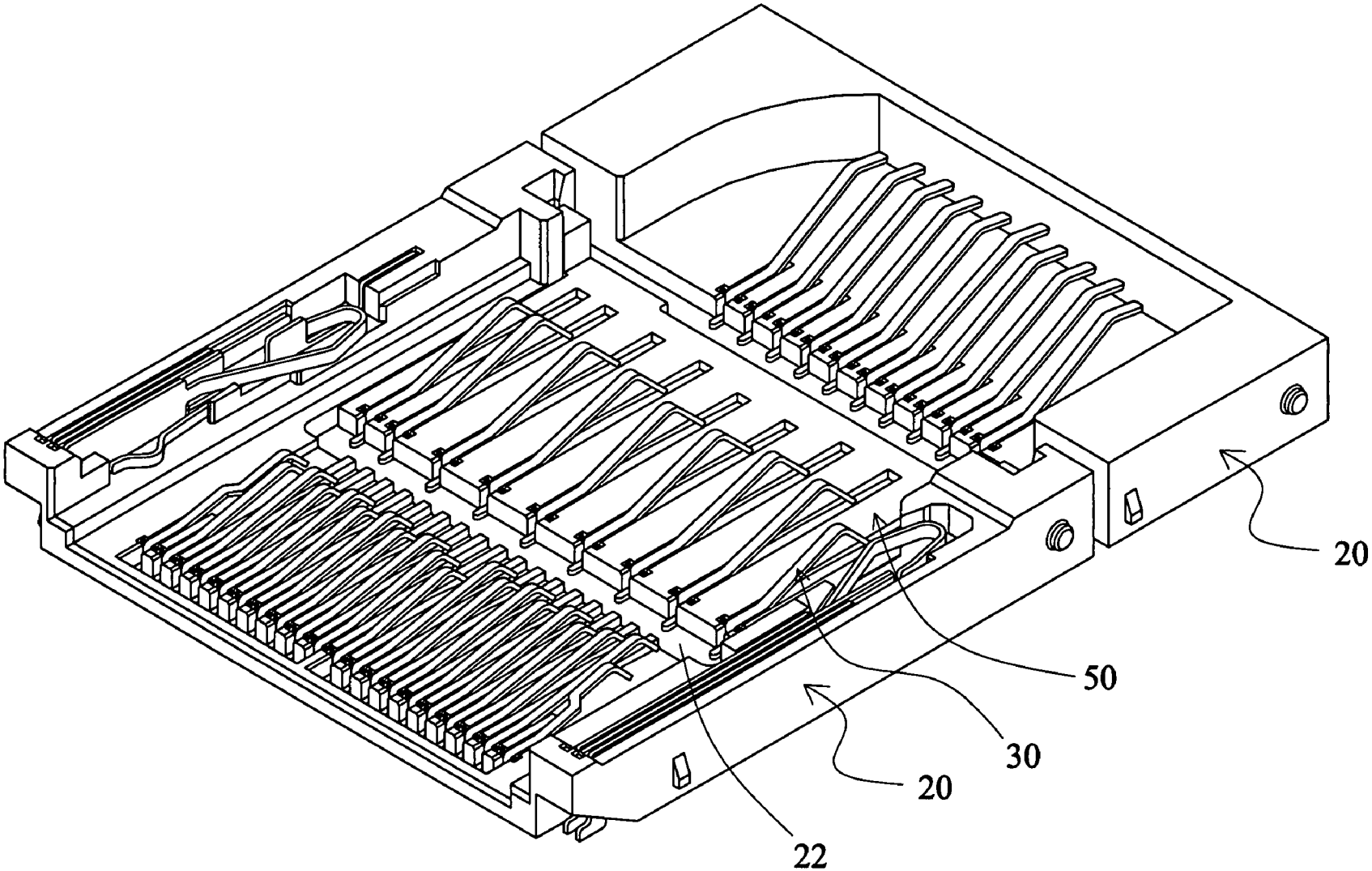
FIG. 9 is a pictorially assembled view showing a plastic base according to the second embodiment of the invention.

Referring to FIGS. 8 and 9, an electrical card connector according to a second embodiment of the invention includes two first floating bases 20, a second floating base 50, a plurality of terminals 30 (first terminals 30 disposed on the first floating bases 20 and second terminals 30 disposed on the second floating base 50), an outer casing 40, a first positioning structure, and a second positioning structure.

The two floating bases 20 and the second floating base 50 in different shapes constitute a plastic base of the electrical connector. Three rows of terminals 30 are respectively disposed on the floating bases 20 and the second floating base 50. Each terminal 30 has an elastic contact 31 and a pin 32 to be bonded to a circuit board. The pin 32 extends horizontally to a first end of each of the floating bases 20 or the second floating base 50. Each of the floating bases 20 and 50 also has a second end opposite to the first end. One of the floating bases 20 is formed with a chamber 22 in which the second floating base 50 is disposed.

The outer casing 40 made of an iron material has a structure substantially the same as that of the first embodiment.

The first positioning structure is disposed on the outer casing 40 and each floating base 20 to make the floating bases 20 movable only in a vertical direction after the floating bases 20 engage with the outer casing 40. The first positioning structure includes pivots 25 disposed at two sides of the second end of each of the floating bases 20, engaging blocks 27 disposed at two sides of the first end of each of the floating bases 20, pivotal holes 45 formed on the side surfaces 42 of the outer casing 40 corresponding to the pivots 25, and engagement openings 46 formed on the side surfaces of the outer casing 40 corresponding to the engaging blocks 27. The vertical dimensional of the engagement opening 46 is longer than that of the engaging block 27, such that the first end of each floating base 20 may be moved vertically relative to the outer casing 40.

The second positioning structure is disposed on one of the floating bases 20 and the second floating base 50 to make the second floating base 50 movable only in a vertical direction when the second floating base 50 is disposed in the chamber 22 of the floating base 20.

The second positioning structure includes pivots 51 disposed at the second end of the second floating base 50, slots 52 formed at two sides of the first end of the second floating base 50, pivotal holes 23 formed on the floating bases 20 corresponding to the pivots 51, and engaging blocks 48 formed on the floating bases 20 corresponding to the slots 52. The height of the slot 52 is larger than that of the engaging block 48 such that the first end of the second floating base 50 may be moved vertically relative to the floating base 20.

Consequently, the second floating base 50 may be moved vertically relative to one of the floating bases 20, and the two floating bases 20 may be moved vertically relative to the outer casing 40. Thus, the pins 32 of the terminals 30 on the two floating bases 20 and the second floating base 50 as well as the mounting sheets 44 of the outer casing 40 may be adjusted to locate at the same level such that the bonding effects of the pins to the circuit board may be enhanced.

Because the pins of the terminals according to the embodiments extend horizontally, the terminals of such a type of connector can be poorly bonded. According to the structures of the invention, the bonding effect may be enhanced. In addition, the invention is also applicable to the connectors having the pins of terminals in the form of solder balls and can further enhance the bonding effect.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An electrical connector, comprising:

at least two floating bases which may be moved vertically, wherein at least one row of terminals is disposed on each of the at least two floating bases, and each of the terminals has an elastic contact and a pin to be bonded to a horizontal circuit board;

an outer casing engaging with the at least two floating bases and covering a top and two sides of each of the at least two floating bases; and a positioning structure disposed on the outer casing and each of the at least two floating bases to make each of the at least two floating bases movable only in a vertical direction.

2. The electrical connector according to claim 1, wherein:

the pin of each of the terminals extends to a first end of each of the at least two floating bases;

the positioning structure has pivots disposed on two sides of a second end of each of the at least two floating bases, wherein the second end is opposite to the first end; and pivotal holes are formed on the outer casing at locations corresponding to the pivots, such that the first end of each of the at least two floating bases, at which the pin of the terminal is located, can be moved vertically relative to the outer casing.

3. The electrical connector according to claim 2, wherein the positioning structure comprises:

engaging blocks disposed at two sides of the first end of each of the at least two floating bases, at which the pin of the terminal is located; and engagement openings formed on the outer casing corresponding to the engaging blocks, wherein each of the engagement openings has a vertical dimension longer than a vertical dimension of each of the engaging blocks.

4. The electrical connector according to claim 2, wherein a top of each of the pivots of the at least two floating bases is formed a guide bevel.

5. The electrical connector according to claim 4, wherein a top of each of the engaging blocks of each of the at least two floating bases is formed with a guide bevel.

6. The electrical connector according to claim 1, wherein the outer casing covers the at least two floating bases to form card slots with different widths or heights, and the card slots share a space.

7. The electrical connector according to claim 1, wherein the outer casing has a top surface and two side surfaces, and ribs extending downwardly from the top surface are formed at two sides of the top surface so as to form the card slots in conjunction with the at least two floating bases.

8. The electrical connector according to claim 1, wherein the pin of each of the terminals extends horizontally.

9. The electrical connector according to claim 1, wherein the outer casing is made of a metallic material, and mounting sheets to be bonded to the circuit board are formed at two sides of the outer casing.

10. The electrical connector according to claim 1, wherein the outer casing has a top surface and two side surfaces, and connections between the top surface and the two side surfaces are formed with a plurality of reinforcement ribs such that a structure intensity of the inverse-U shaped outer casing is enhanced.

11. An electrical connector, comprising:

a first floating base on which a row of first terminals is disposed, wherein each of the row of first terminals has an elastic contact and a pin to be bonded to a horizontal circuit board, and the first floating base has a chamber;

a second floating base disposed in the chamber of the first floating base, wherein a row of second terminals is disposed on the second floating base, each of the row of second terminals has an elastic contact and a pin to be bonded to the circuit board;

an outer casing engaging with the first floating base and covering a top and two sides of the first floating base;

a first positioning structure disposed on the outer casing and the first floating base to make the first floating base movable only in a vertical direction after the first floating base engages with the outer casing; and a second positioning structure disposed on the first floating base and the second floating base to make the second floating base movable only in a vertical direction after the second floating base is disposed in the chamber of the first floating base.

12. The electrical connector according to claim 11, wherein:

the pins of the first terminals on the first floating base extend to a first end of the first floating base; and the first positioning structure comprises pivots disposed at two sides of a second end of the first floating base, and pivotal holes formed on the outer casing corresponding to the pivots such that the first end of the first floating base may be moved vertically relative to the outer casing, wherein the second end of the first floating base is opposite to the first end of the first floating base.

13. The electrical connector according to claim 12, wherein the first positioning structure comprises engaging blocks disposed on two sides of the first end of the first floating base, and engagement openings formed on the outer casing corresponding to the engaging blocks, and a vertical dimension of each of the engagement openings is longer than a vertical dimension of each of the engaging blocks.

14. The electrical connector according to claim 11, wherein:

the pins of the second terminals on the second floating base extend to a first end of the second floating base; and the second positioning structure comprises pivots disposed at two sides of a second end of the second floating base, and pivotal holes formed on the first floating base corresponding to the pivots to make the first end of the second floating base movable only in a vertical direction, wherein the second end of the second floating base is opposite to the first end of the second floating base.

15. The electrical connector according to claim 14, wherein the second positioning structure comprises slots formed at two sides of the first end of the second floating base, and engaging blocks disposed on the first floating base corresponding to the slots, wherein a height of each of the slots is greater than a height of each of the engaging blocks.

16. The electrical connector according to claim 11, wherein the outer casing covers the first floating base to form card slots having different widths or heights, and the card slots share a space.

17. The electrical connector according to claim 11, wherein the outer casing has a top surface and two side surfaces, and ribs extending downwardly from the top surface are formed at two sides of the top surface so as to form the card slots in conjunction with the first floating base.

18. The electrical connector according to claim 11, wherein the pin of each of the first and second terminals extends horizontally.

19. The electrical connector according to claim 11, wherein the outer casing is made of a metallic material, and mounting sheets to be bonded to the circuit board are formed at two sides of the outer casing.

* * * * *